US008384498B2

(12) United States Patent
Grondahl et al.

(10) Patent No.: US 8,384,498 B2
(45) Date of Patent: Feb. 26, 2013

(54) CAPACITIVELY LOADED SPURLINE FILTER

(75) Inventors: Christopher D. Grondahl, Gilbert, AZ (US); Michael R. Lyons, Gilbert, AZ (US); Dean Lawrence Cook, Mesa, AZ (US)

(73) Assignee: ViaSat, Inc., Carlsbad, CA (US)

( * ) Notice: Subject to any disclaimer, the term of this patent is extended or adjusted under 35 U.S.C. 154(b) by 578 days.

(21) Appl. No.: 12/613,724

(22) Filed: Nov. 6, 2009

(65) Prior Publication Data

US 2010/0117766 A1 May 13, 2010

Related U.S. Application Data

(60) Provisional application No. 61/112,613, filed on Nov. 7, 2008.

(51) Int. Cl.
*H01P 1/203* (2006.01)
*H01P 7/08* (2006.01)

(52) U.S. Cl. ..... 333/204; 333/219

(58) Field of Classification Search ..... 333/202–205, 333/219, 235, 176
See application file for complete search history.

(56) References Cited

U.S. PATENT DOCUMENTS 5,015,976 A * 5/1991 Saka ..... 333/204
5,691,676 A * 11/1997 Snel et al. ..... 333/204
6,091,312 A * 7/2000 Sheen ..... 333/176
6,603,372 B1 * 8/2003 Ishizaki et al. ..... 333/204
2002/0130734 A1 * 9/2002 Liang et al. ..... 333/134
2006/0044074 A1 3/2006 Chang et al.
2006/0087387 A1 4/2006 Kubota et al.

FOREIGN PATENT DOCUMENTS

KR 100363787 12/2002
KR 1020030057910 7/2003

OTHER PUBLICATIONS

International Preliminary Report on Patentability dated May 10, 2011, 5 pages.
International Search Report and Written Opinion dated Jun. 11, 2010 10 pages.

* cited by examiner

*Primary Examiner* — Benny Lee
*Assistant Examiner* — Gerald Stevens
(74) *Attorney, Agent, or Firm* — Snell & Wilmer LLP

(57) ABSTRACT

In an exemplary embodiment, a spurline filter comprises a capacitive element connected to a spur and either a through-line of the spurline filter or ground. In another embodiment, multiple capacitive elements are connected to the spur. In an exemplary embodiment, the capacitively loaded spurline filter provides a band rejection frequency response similar to the band rejection frequency response of a similar spurline filter that does not comprise at least one capacitive element but the capacitively loaded spurline filter has half the layout area or less. In an exemplary embodiment, the spurline filter comprises capacitive elements, where the capacitive elements are configured to reduce the resonant frequency of the filter.

17 Claims, 6 Drawing Sheets

CAPACITIVELY LOADED SPURLINE FILTER

CROSS-REFERENCE TO RELATED APPLICATIONS

This application is a non-provisional of and claims priority to U.S. Provisional Patent Application No. 61/112,613, entitled "CAPACITIVELY LOADED SPURLINE FILTER" and filed Nov. 7, 2008, which is hereby incorporated by reference.

FIELD OF INVENTION

The application relates to systems, devices, and methods related to a capacitively loaded spurline filter.

BACKGROUND OF THE INVENTION

A spurline filter is an effective band rejection filter. With reference to prior art FIG. 1, a layout of a prior art single-resonator spurline filter 100 includes a through-line 101 of the filter and a single spur 102. The single-resonator spurline filter 100 provides a band rejection notch at a resonant frequency of an incident signal. Similarly, FIG. 2 illustrates a dual-resonator spurline filter 200 comprising a through-line 201 of the filter, a first spur 202, and a second spur 203. In general, a dual-resonator spurline filter provides a wider band frequency rejection response than the single-resonator spurline filter.

In both single and dual spurlines, the length of the spur is designed to be a quarter wavelength (¼ λ) in length, and thus determines the band rejection center frequency. Therefore, a spurline filter can be designed with a different center frequency of the band rejection by adjusting the spur length. However, a spurline filter configured to be an effective band rejection filter generally results in a large filter size, particularly in length. Thus, a need exists for improved spurline filter systems, methods and devices for addressing these and other issues.

SUMMARY OF THE INVENTION

In accordance with various aspects of the present invention, a system for a capacitively loaded spurline filter is presented. In an exemplary embodiment, a spurline filter is configured with capacitive elements, which facilitate a reduction in filter size while providing the same filtering performance in comparison to typical spurline filters that do not have capacitive elements. In one exemplary embodiment, implementation of capacitive elements reduces the spurline filter size by about 50% of the layout area while maintaining performance.

In an exemplary embodiment, a spurline filter comprises a capacitive element connected to a spur and either a through-line of the spurline filter or ground. In another embodiment, multiple capacitive elements are connected to the spur. In an exemplary embodiment, the capacitively loaded spurline filter provides a band rejection frequency response similar to the band rejection frequency response of a similar spurline filter that does not comprise at least one capacitive element but the capacitively loaded spurline filter has half the layout area or less. In an exemplary embodiment, the spurline filter comprises capacitive elements, where the capacitive elements are configured to reduce the resonant frequency of the filter.

In another exemplary embodiment, a dual spurline filter comprises a through-line, a first spur and a second spur coupled to the through-line. A first capacitive element connects the through-line and the first spur, while a second capacitive element connects the through-line and the second spur. Similarly to the single spurline filter, the capacitive elements enhance the coupling effect and result in a decreased layout area.

BRIEF DESCRIPTION OF THE DRAWING FIGURES

A more complete understanding of the present invention may be derived by referring to the detailed description and claims when considered in connection with the drawing figures, wherein like reference numbers refer to similar elements throughout the drawing figures, and:

DETAILED DESCRIPTION

While exemplary embodiments are described herein in sufficient detail to enable those skilled in the art to practice the invention, it should be understood that other embodiments may be realized and that logical electrical and mechanical changes may be made without departing from the spirit and scope of the invention. Thus, the following detailed description is presented for purposes of illustration only.

Figure 1:
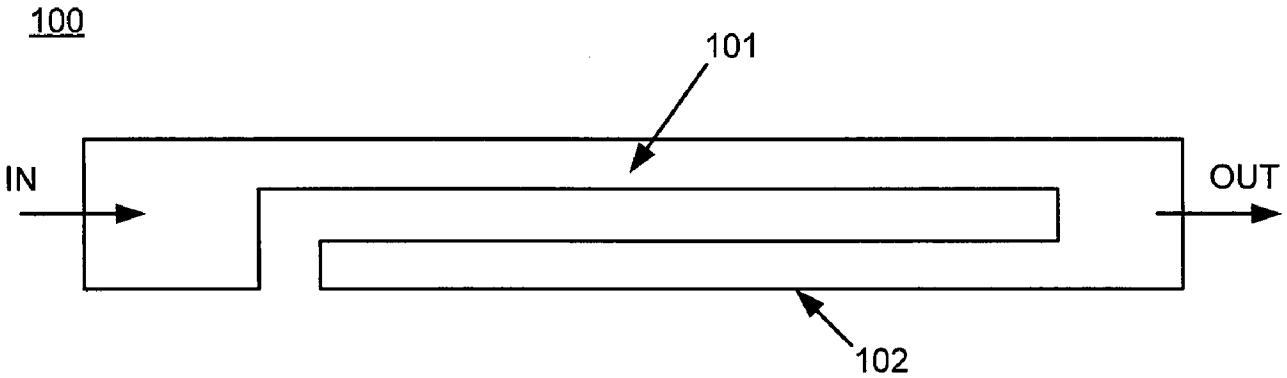
FIGURE 1 (PRIOR ART)
FIG. 1 illustrates a prior art single resonator spurline filter.
Figure 2:
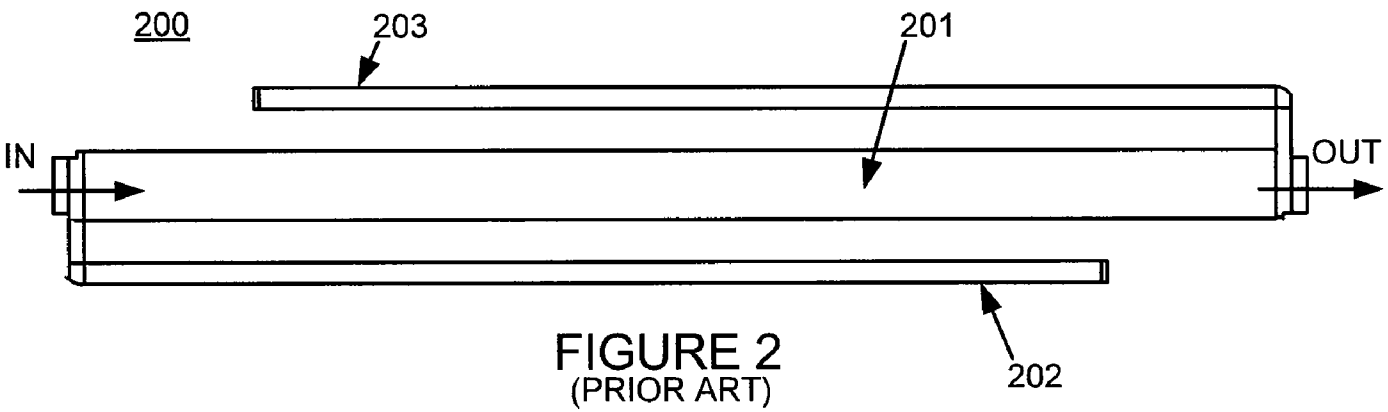
FIGURE 2 (PRIOR ART)
FIG. 2 illustrates a layout of a prior art dual resonator spurline filter.
Figure 3:
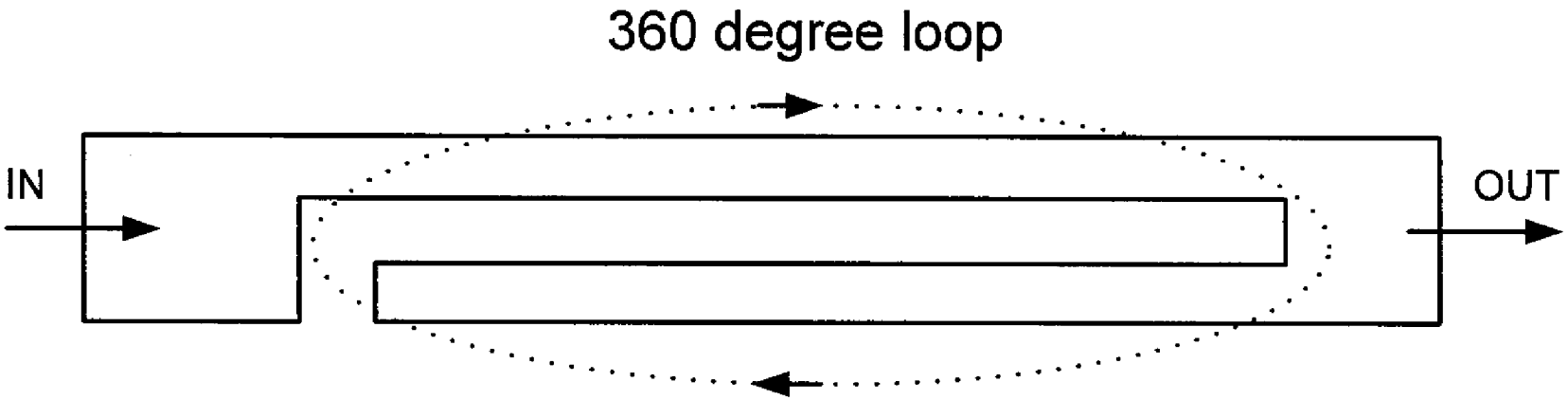
FIG. 3 illustrates a 360° resonant loop of a single resonator spurline filter.

In an exemplary embodiment, a single-resonator spurline filter may be viewed as a 360° resonant loop, as illustrated in FIG. 3. The length of a conventional single-resonator spur line is a quarter of the signal wavelength (λ/4). An input signal with a normalized phase of 0° travels down the through-line and then back up through the spur. When the signal has reached the open end of the spur, it has traveled λ/2 and has a phase of 180°. The signal at the end of the spur and the input signal are now 180° out of phase, which is conducive to odd-mode coupling. Thus the 360° loop is a combination of the 180° path down the through-line and back up the spur and the 180° odd-mode coupling.

In an exemplary embodiment, the resonance frequency of a spurline filter may be lowered by increasing the odd-mode coupling at the open end of the spur by adding capacitive elements between the open end of the spur and the through-line. In another exemplary embodiment, connecting the open end of spur with capacitive elements to ground may also be beneficial.

In an exemplary embodiment, the spurline filter comprises capacitive elements. In a further exemplary embodiment, the capacitive elements are configured to reduce the resonant frequency of the filter. Thus, by designing the capacitive elements to reduce the resonant frequency, the physical length component of the filter may be reduced.

Figure 4A:
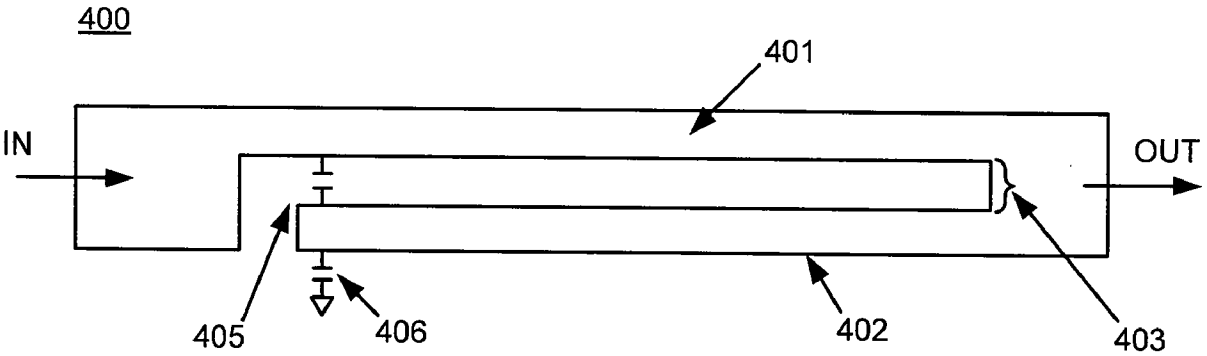
FIG. 4A illustrates a schematic diagram of an exemplary capacitively loaded single-resonator spurline filter.

In accordance with an exemplary embodiment and with reference to FIG. 4A, a spurline filter 400 comprises at least one through-line 401, at least one spur 402, and at least one capacitive element 405, 406. In one exemplary embodiment, the capacitive element may connect the spurline to ground (as shown by 406). In another exemplary embodiment, the capacitive element may connect the spurline to through-line 401 of spurline filter 400 (as shown by 405). In another exemplary embodiment, both capacitive elements 405, 406 are used in spurline filter 400. Stated another way, in an exemplary embodiment, spur 402 is connected to both through-line 401 and ground through respective capacitors.

Furthermore, spurline filter 400 comprises a spurline gap 403 formed by the area between through-line 401 and spur 402. In an exemplary embodiment, at least one of capacitive elements 405, 406 comprises a capacitor, multiple capacitors in series and/or parallel, or other suitable electronic component of capacitive nature as known in the art or hereinafter devised. For example, capacitive elements 405, 406 could be distributed capacitive elements and edge-coupled capacitive elements. In an exemplary embodiment, capacitive elements 405, 406 may be located at, or near, the open end of spur 402. Locating the capacitive elements near the open end of the spur enhances the coupling of the spurline filter, resulting in a physically smaller loop.

Figure 4B:
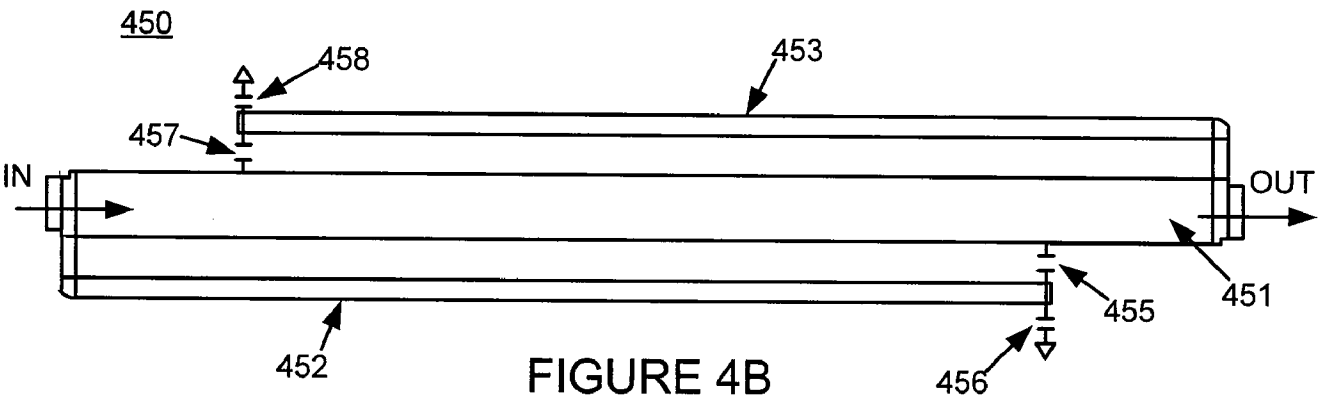
FIG. 4B illustrates a schematic diagram of an exemplary capacitively loaded dual-resonator spurline filter.

In another exemplary embodiment and with reference to FIG. 4B, a dual spurline filter 450 comprises at least two capacitive elements 455, 456. One capacitive element 456 connects a first spur 452 to ground. The other capacitive element 455 connects first spur 452 to a through-line 451 of dual spurline filter 450. Furthermore, in another exemplary embodiment, dual spurline filter 450 further comprises a second spur 453 in communication with two capacitive elements 457, 458. Capacitive element 458 connects second spur 453 to ground. The other capacitive element 457 connects second spur 453 to through-line 451. In an exemplary embodiment, dual spurline filter 450 has similar behavior characteristics as single spurline filter 400. Specifically, adding capacitive elements to dual spurline filter 450 enables designing a spurline filter that still has the performance characteristics of a spurline filter but is approximately half the length of a similar spurline filter without capacitive elements added.

Figure 5A:
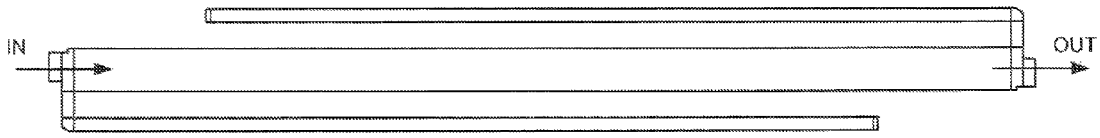
FIGS. 5A-5C illustrate an exemplary embodiment of a capacitively loaded dual-resonator spurline filter in comparison to a prior art dual-resonator spurline filter.
Figure 5B:
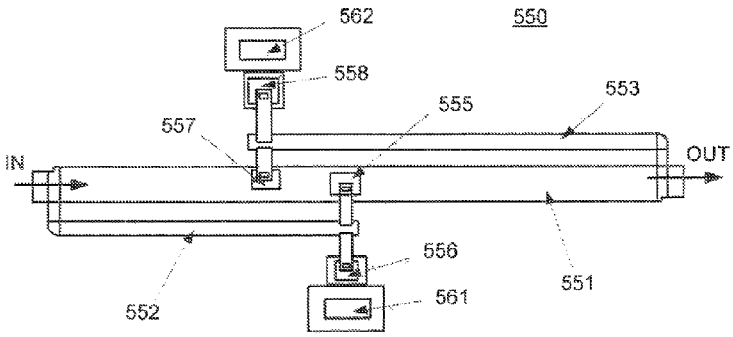

In an exemplary embodiment and as illustrated to scale by FIGS. 5A and 5B, a spurline filter with capacitive elements has a layout area about 50% smaller than the layout area of a typical spurline filter, while achieving substantially the same band rejection filter performance as a similar spurline filter without capacitive elements. Furthermore, in another exemplary embodiment, a capacitively loaded spurline filter has a significantly reduced layout area in comparison to a similarly effective spurline filter without capacitive elements. For example, the capacitively loaded spurline filter may have a layout area reduction of greater than 25%, greater than 33%, greater than 50% in comparison to a non-capacitive spurline filter. Moreover, in an exemplary embodiment, a spurline filter is designed with a through-line length of approximately $\lambda/8$, where $\lambda$ corresponds to a central rejection frequency of the spurline filter. A typical non-capacitively loaded spurline filter will have a through-line length of about $\lambda/4$. The capacitive element connected to the spur and either the ground or through-line enables the reduction of through-line length.

Figure 5C:
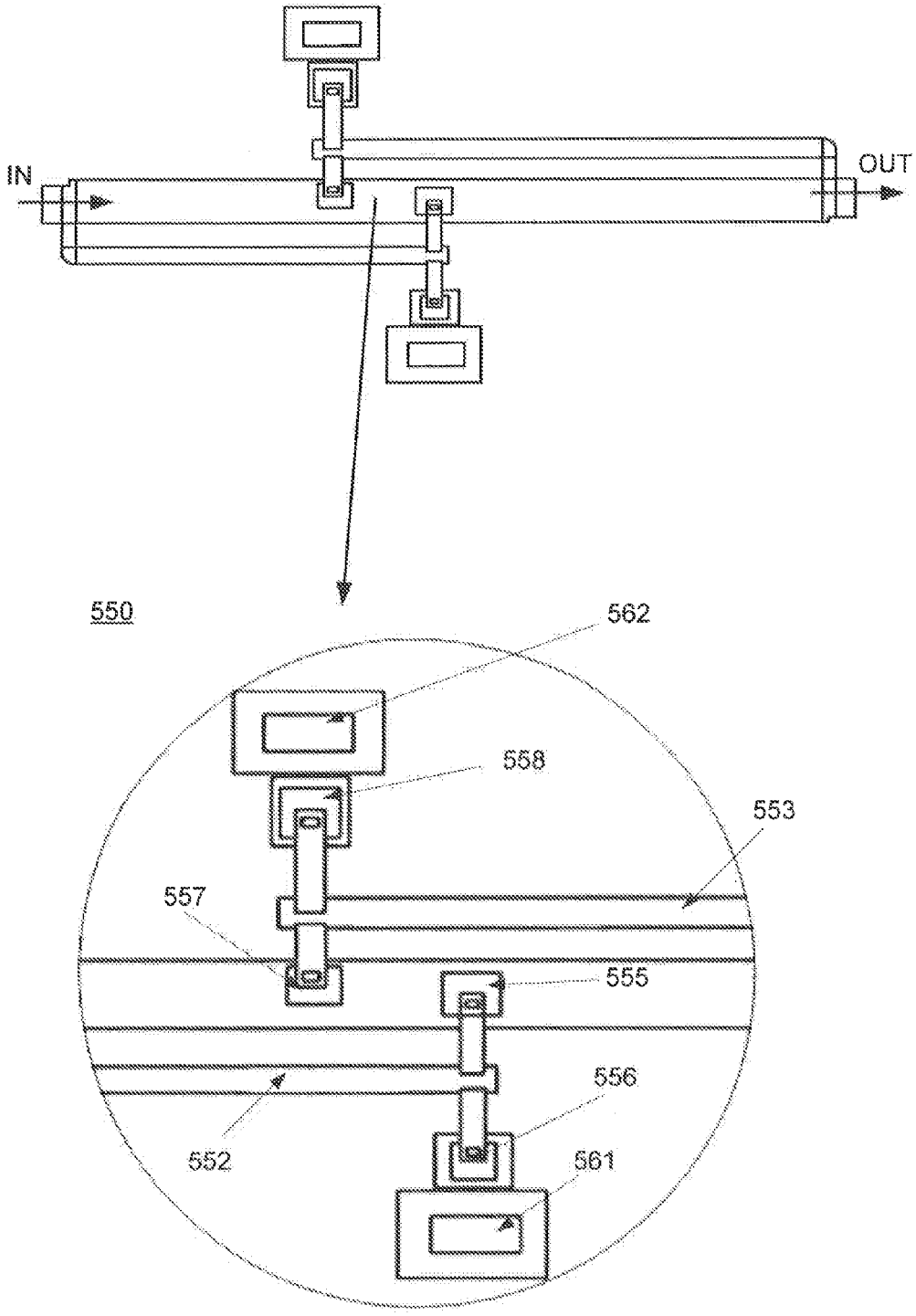

In another exemplary embodiment and with reference to FIGS. 5B and 5C, a dual spurline filter 550 comprises at least two capacitive elements 555, 556. Dual spurline filter 550 is similar to, and may have the same elements as, dual spurline filter 450. In dual spurline filter 550, one capacitive element 556 connects a first spur 552 to a first ground via 561. The other capacitive element 555 connects first spur 552 to a through-line 551 of dual spurline filter 550. Furthermore, in another exemplary embodiment, dual spurline filter 550 further comprises a second spur 553 in communication with two capacitive elements 557, 558. Capacitive element 558 connects second spur 553 to a second ground via 562. The other capacitive element 557 connects second spur 553 to through-line 551.

Figure 6:
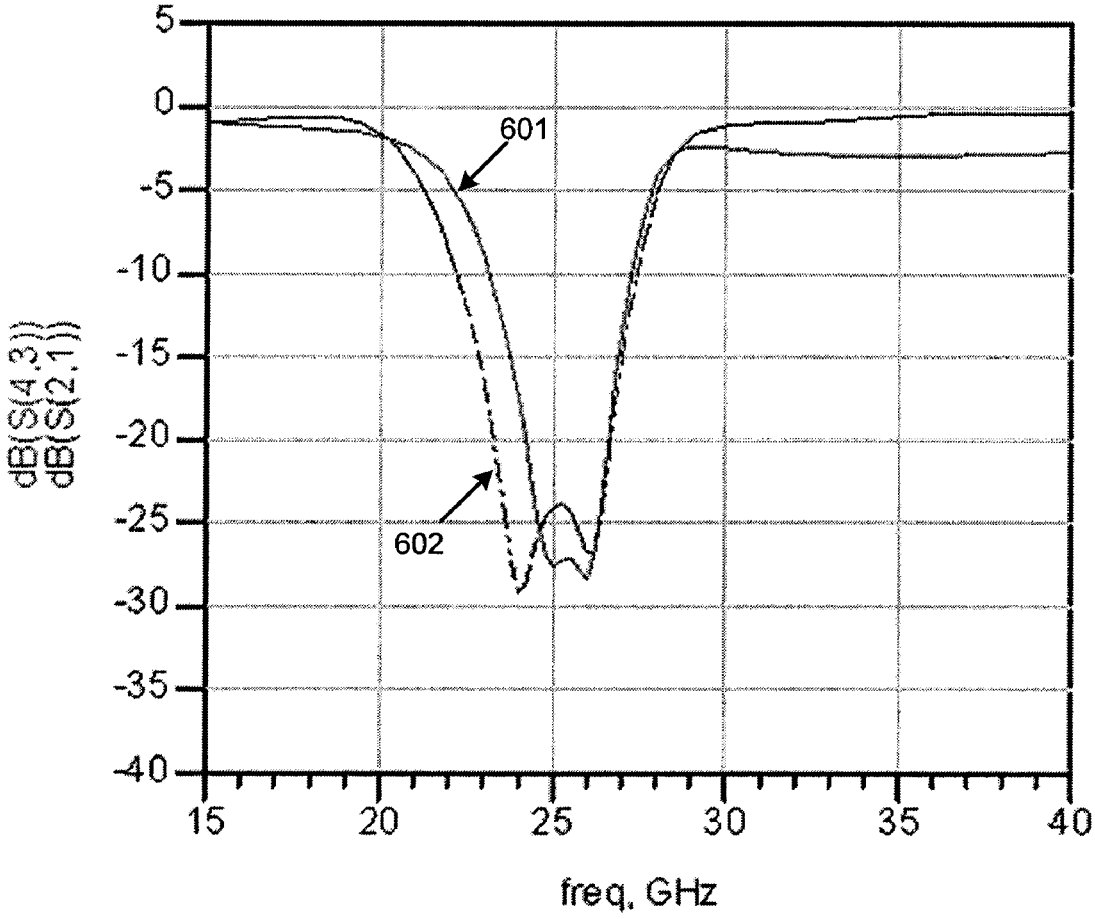
FIG. 6 illustrates a frequency response graph comparing a prior art spurline filter and an exemplary embodiment of a capacitively loaded spurline filter.

FIG. 6 illustrates graphs of exemplary frequency responses for the two spurline filters shown in the exemplary embodiment referenced in FIGS. 5A and 5B. In an exemplary embodiment and with reference to the graph of FIG. 6, the frequency response of a spurline filter comprising capacitive elements 601 is similar to the frequency response of a conventional spurline filter 602 that has a layout area twice as large as the exemplary spurline filter.

In accordance with an exemplary embodiment, a capacitively loaded spurline filter may be used in a microstrip, stripline, suspended stripline, and other similar conductive line media. In an exemplary embodiment, if the spurline filter is built in a stripline, then small cavities may be provided in the stripline media to allow for the capacitive elements. Moreover, the capacitively loaded spurline filter may be used on a printed circuit board or in a MMIC.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

What is claimed is:

1. A spurline filter comprising:

at least one through-line of the spurline filter;

a spur connected to the at least one through-line, wherein the spur is substantially parallel with the at least one through-line and configured to form a 360° resonant loop; and a first capacitive element in communication with the spur;

wherein the first capacitive element is connected to at least one of ground or the at least one through-line; and wherein the at least one through-line has a length of approximatelv $\lambda/8$, where $\lambda$ corresponds to a central rejection frequencv of the spurline filter.

2. The spurline filter of claim 1, wherein the spurline filter is configured to provide a band rejection frequency response similar to a band rejection frequency response of a similar spurline filter that does not comprise at least one capacitive element, and wherein the spurline filter has half the layout area or less than the similar spurline filter.

3. The spurline filter of claim 1, further comprising a second capacitive element connected to the spur, wherein the first capacitive element and the second capacitive element are connected to ground and the at least one through-line, respectively.

4. The spurline filter of claim 1, wherein the first capacitive element is at least one of a capacitor or multiple capacitors.

5. The spurline filter of claim 1, wherein the first capacitive element is at least one of a distributed capacitive element and an edge-coupled capacitive element.

6. The spurline filter of claim 1, wherein the spurline filter is part of a printed circuit board or MMIC.

7. The spudine filter of claim 1, wherein the spurline filter is part of a microstrip, stripline, or suspended stripline.

8. The spudine filter of claim 1, wherein the spurline filter is part of a stripline, and where the spurline filter further comprises cavities to allow for the first capacitive element.

9. The spurline filter of claim 1, wherein the spurline filter has a layout area that is reduced by at least 25% in comparison to a non-capacitive element spurline filter with similar frequency response.

10. The spurline filter of claim 1, wherein the spurline filter has a layout area that is reduced by at least 33% in comparison to a non-capacitive element spurline filter with similar frequency response.

11. The spurline filter of claim 1, wherein the spurline filter has a layout area that is reduced by at least 50% in comparison to a non-capacitive element spurline filter with similar frequency response.

12. The spurline filter of claim 1, wherein the spurline filter has a length that is reduced by at least 50% in comparison to a non-capacitive element spurline filter with similar frequency response.

13. A dual spurline filter comprising:

at least one through-line of the dual spurline filter;

a first spur and a second spur coupled to the at least one through-line, wherein both the first spur and the second spur are substantially parallel with the at least one through-line and configured to form a 360° resonant loop;

a first capacitive element connected to the first spur and to one of the at least one through-line or ground; and a second capacitive element connected to the second spur and to one of the at least one through-line or ground;

wherein the at least one through-line has a length of approximately $\lambda/8$, where $\lambda$ corresponds to a central rejection frequency of the dual spurline filter.

14. The dual spurline filter of claim 13, further comprising:

a third capacitive element connected to the first spur;

a fourth capacitive element connected to the second spur;

wherein the first and third capacitive elements are connected to the at least one through-line and ground, respectively; and wherein the second and fourth capacitive elements are connected to the at least one through-line and ground, respectively.

15. The dual spurline filter of claim 13, wherein the dual spurline filter has a resonant frequency length that is reduced by at least 25% in comparison to a non-capacitive element dual spurline filter with similar size.

16. The dual spurline filter of claim 13, wherein the dual spurline filter has a resonant frequency length that is reduced by at least 33% in comparison to a non-capacitive element dual spurline filter with similar size.

17. The dual spurline filter of claim 13, wherein the dual spurline filter has a resonant frequency length that is reduced by at least 50% in comparison to a non-capacitive element dual spurline filter with similar size.

* * * * *

UNITED STATES PATENT AND TRADEMARK OFFICE

CERTIFICATE OF CORRECTION

PATENT NO. : 8,384,498 B2
APPLICATION NO. : 12/613724
DATED : February 26, 2013
INVENTOR(S) : Christopher D. Grondahl et al.

It is certified that error appears in the above-identified patent and that said Letters Patent is hereby corrected as shown below:

In the Claims:

Col. 5, Line 1, should read:
7. The spurline filter of claim 1, wherein the spurline filter is part of a microstrip, stripline, or suspended stripline.

Col. 5, Line 3, should read:
8. The spurline filter of claim 1, wherein the spurline filter is part of a stripline, and where the spurline filter further comprises cavities to allow for the first capacitive element.

Signed and Sealed this
Seventh Day of May, 2013

Teresa Stanek Rea
*Acting Director of the United States Patent and Trademark Office*